US009774143B1

(12) United States Patent
Su et al.

(10) Patent No.: US 9,774,143 B1
(45) Date of Patent: Sep. 26, 2017

(54) HIGH FREQUENCY SIGNAL COMMUNICATION CONNECTOR WITH IMPROVED CROSSTALK PERFORMANCE

(71) Applicant: NEXTRONICS ENGINEERING CORP., New Taipei (TW)

(72) Inventors: Hou-An Su, Keelung (TW); Hung-Wei Hsu, Taipei (TW); Chi-Jung Chan, New Taipei (TW); Ray-Cheh Wu, Taipei (TW)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 15/353,591

(22) Filed: Nov. 16, 2016

(30) Foreign Application Priority Data

Jul. 13, 2016 (TW) ..... 105122053 A

(51) Int. Cl.

| | |
|---|---|
| ***H01R 13/648*** | (2006.01) |
| ***H01R 13/6471*** | (2011.01) |
| ***H01R 24/60*** | (2011.01) |
| ***H01R 13/6588*** | (2011.01) |
| *H01R 107/00* | (2006.01) |
| *H01R 13/6585* | (2011.01) |

(Continued)

(52) U.S. Cl.
CPC ..... *H01R 13/6471* (2013.01); *H01R 13/6588* (2013.01); *H01R 24/60* (2013.01); *H01R 13/6585* (2013.01); *H01R 13/6586* (2013.01); *H01R 13/6594* (2013.01); *H01R 2107/00* (2013.01)

(58) Field of Classification Search
CPC ..... H01R 13/6585; H01R 13/6586; H01R 13/6594
USPC .... 439/607.12, 607.2, 607.21, 607.23, 607.4
See application file for complete search history.

(56) References Cited

U.S. PATENT DOCUMENTS 6,558,191 B2 * 5/2003 Bright ..... G02B 6/4246 439/541.5
6,600,865 B2 * 7/2003 Hwang ..... H01R 23/6873 361/760

(Continued)

FOREIGN PATENT DOCUMENTS

TW M517932 U 2/2016

*Primary Examiner* — Tho D Ta
(74) *Attorney, Agent, or Firm* — Li & Cai Intellectual Property (USA) Office

(57) ABSTRACT

A high frequency signal communication connector with improved crosstalk performance includes an insulated housing, a plurality of first terminals, a plurality of second terminals, a conductive shielding layer, and a metal shell. The insulated housing has two inserting slots. The first and second terminals are disposed in the insulated housing, and have front ends respectively extending into the two inserting slots, and rear ends respectively extending outside a bottom of the insulated housing. The conductive shielding layer is provided on the insulated housing, and is disposed with a plurality of through holes. The first and second terminals respectively pass through the through holes, so that the conductive shielding layer covers a part of the first and second terminals. The first and second terminals have grounding terminals contacting with the conductive shielding layer, so that the terminals have better shielding effectiveness to reduce crosstalk interference.

10 Claims, 12 Drawing Sheets

(51) Int. Cl.
*H01R 13/6586* (2011.01)
*H01R 13/6594* (2011.01)

(56) References Cited

U.S. PATENT DOCUMENTS 7,963,799 B1 * 6/2011 Lee ..... H01R 12/724
439/541.5
8,123,559 B2 * 2/2012 Brown ..... G02B 6/4201
361/816
8,641,449 B2 * 2/2014 Cai ..... H01R 13/6581
439/515
8,992,254 B2 * 3/2015 Banakis ..... H01R 12/721
439/607.23
9,356,401 B1 * 5/2016 Horning ..... H01R 13/6585

* cited by examiner

HIGH FREQUENCY SIGNAL COMMUNICATION CONNECTOR WITH IMPROVED CROSSTALK PERFORMANCE

BACKGROUND

1. Technical Field

The present disclosure relates to a high frequency signal communication connector, in particular, to a high frequency signal communication connector with improved crosstalk performance.

2. Description of Related Art

Current transceiver modules are mainly used to connect to the circuit board of the communication line or other electrical equipment. Different industry standards define the specifications of the connectors used to connect the computer with the external communication apparatuses such as the modem, network interface, and so on. It is well-known that the GigaBit Interface Converter (GBIC) is the transceiver module used to communicate the computer with the Ethernet network, fiber channel, or other data communications environments. In order to achieve higher port density when connecting to network equipment such as the network switch, cable patch panel, wiring box, output/input ports of the computer, and so on, it is desired to miniaturize the transceiver module. The Quad Small Form-Factor Pluggable (QSFP) meets this demand. Because the QSFP has a smaller volume than the GBIC, high-density communication performance can be achieved more easily by using it. However, the terminals of the existing small pluggable connectors do not provide the good shielding effectiveness and cannot effectively avoid crosstalk interference.

In view of this, the present disclosure provides a high frequency signal communication connector with improved crosstalk performance to overcome the aforementioned shortcomings.

SUMMARY

The primary purpose of the present disclosure is to provide a high frequency signal communication connector with improved crosstalk performance, wherein the terminals of the communication connector have better shielding property to effectively lower crosstalk interference.

According to one exemplary embodiment of the present disclosure, a high frequency signal communication connector with improved crosstalk performance is provided, including an insulated housing having two inserting slots respectively disposed at an upper end and a lower end of the insulated housing; a plurality of first terminals having a plurality of first grounding terminals; a plurality of second terminals having a plurality of second grounding terminals, wherein the plurality of first terminals and the plurality of second terminals are disposed on the insulated housing, a front end of each of the plurality of first terminals and a front end of each of the plurality of second terminals respectively extend to the two inserting slots of the insulated housing, and a rear end of each of the plurality of first terminals and a rear end of each of the plurality of second terminals respectively extend outside a bottom of the insulated housing; a conductive shielding layer disposed on the insulated housing and having a plurality of through holes, wherein the plurality of through holes penetrate a top surface and a bottom surface of the conductive shielding layer, the plurality of first terminals and the plurality of second terminals respectively pass through the through holes to make the conductive shielding layer cover a part of the plurality of first terminals and a part of the plurality of second terminals, the plurality of first grounding terminals and the plurality of second grounding terminals are in contact with the conductive shielding layer to extend the grounding area, and a metal shell covering an external portion of the insulated housing.

In a preferred embodiment, the metal shell has a top cover, a pair of side covers, a bottom cover and a rear cover; the top cover and the bottom cover are respectively connected to an upper end and a lower end of the pair of side covers, the rear cover connects to a rear end of each of the top cover, the pair of side covers and the bottom cover; an intermediate partition is disposed in the middle of the metal shell; the pair of side covers are respectively disposed with a plurality of first heat dissipation holes which correspond to the intermediate partition, each of the plurality of first dissipation holes is a circular hole and has a diameter ranging from 0.6 mm to 1.4 mm, and the plurality of first dissipation holes are disposed at intervals, wherein each of the intervals is between 0.5 mm and 1.5 mm.

In a preferred embodiment, a first metal partition plate, a second metal partition plate and a third metal partition plate are disposed on the metal shell; the first metal partition plate is disposed at a front end and in the middle of the metal shell, and the second metal partition plate and the third metal partition plate are respectively disposed on the two inserting slots respectively disposed at the upper end and the lower end of the insulated housing.

In a preferred embodiment, one part of the rear ends of the plurality of first terminals is bent relative to the other part of the rear ends of the plurality of first terminals to enable the rear ends of each two adjacent terminals of the plurality of first terminals to be staggered, and one part of the rear ends of the plurality of second terminals is bent relative to the other part of the rear ends of the plurality of second terminals to enable the rear ends of each two adjacent terminals of the plurality of second terminals to be staggered. At least one rear end of each pair of terminals of the plurality of first terminals is bent to form a first horizontal portion and then is bent downward to form a first perpendicular portion, and at least one rear end of each pair of terminals of the plurality of second terminals is bent to form a second horizontal portion and then is bent downward to form a second perpendicular portion.

To sum up, the insulated housing of the present disclosure is disposed with a conductive shielding layer thereon, the conductive shielding layer covers a part of the plurality of first terminals and a part of the plurality of second terminals, and is in contact with the plurality of first grounding terminals and the plurality of second grounding terminals to extend the grounding area, thereby providing the terminals with the better shielding effectiveness so as to effectively avoid crosstalk interference. Although applying the differential mode to the high frequency signal can have better performance for lowering the interference, the anti-interference effect decreases when the high frequency signal is transmitted on one circuit board or the transmission distance changes. The present disclosure provides better effectiveness for lowering the interference by using the conductive shielding layer.

In addition, the pair of side covers of the metal shell of the present disclosure are respectively disposed with a plurality of first heat dissipation holes which have small diameter and are arranged with high density. The plurality of first heat dissipation holes not only can dissipate heat, but also effectively block the interference source.

The metal shell of the present disclosure is disposed with the first metal partition plate, the second metal partition plate and the third metal partition plate thereon which have the shielding effectiveness. By using the metal shell and the metal partition plates, the electromagnetic interference can be avoided effectively.

One part of the rear ends of the plurality of first terminals is bent relative to the other part of the rear ends of the plurality of first terminals to enable the rear ends of each two adjacent terminals of the plurality of first terminals to be staggered, and one part of the rear ends of the plurality of second terminals is bent relative to the other part of the rear ends of the plurality of second terminals to enable the rear ends of each two adjacent terminals of the plurality of second terminals to be staggered. At least one rear end of each pair of terminals of the plurality of first terminals is bent to form a first horizontal portion and then is bent downward to form a first perpendicular portion, and at least one rear end of each pair of terminals of the plurality of second terminals is bent to form a second horizontal portion and then is bent downward to form a second perpendicular portion to enable the pins of the plurality of first terminals and the pins of the plurality of second terminals to be staggered respectively. The bent parts of the plurality of first terminals are closer to the circuit board than the bent parts of the plurality of second terminals, thereby providing better effectiveness of lowering the crosstalk.

In order to further understand the techniques, means and effects of the present disclosure, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
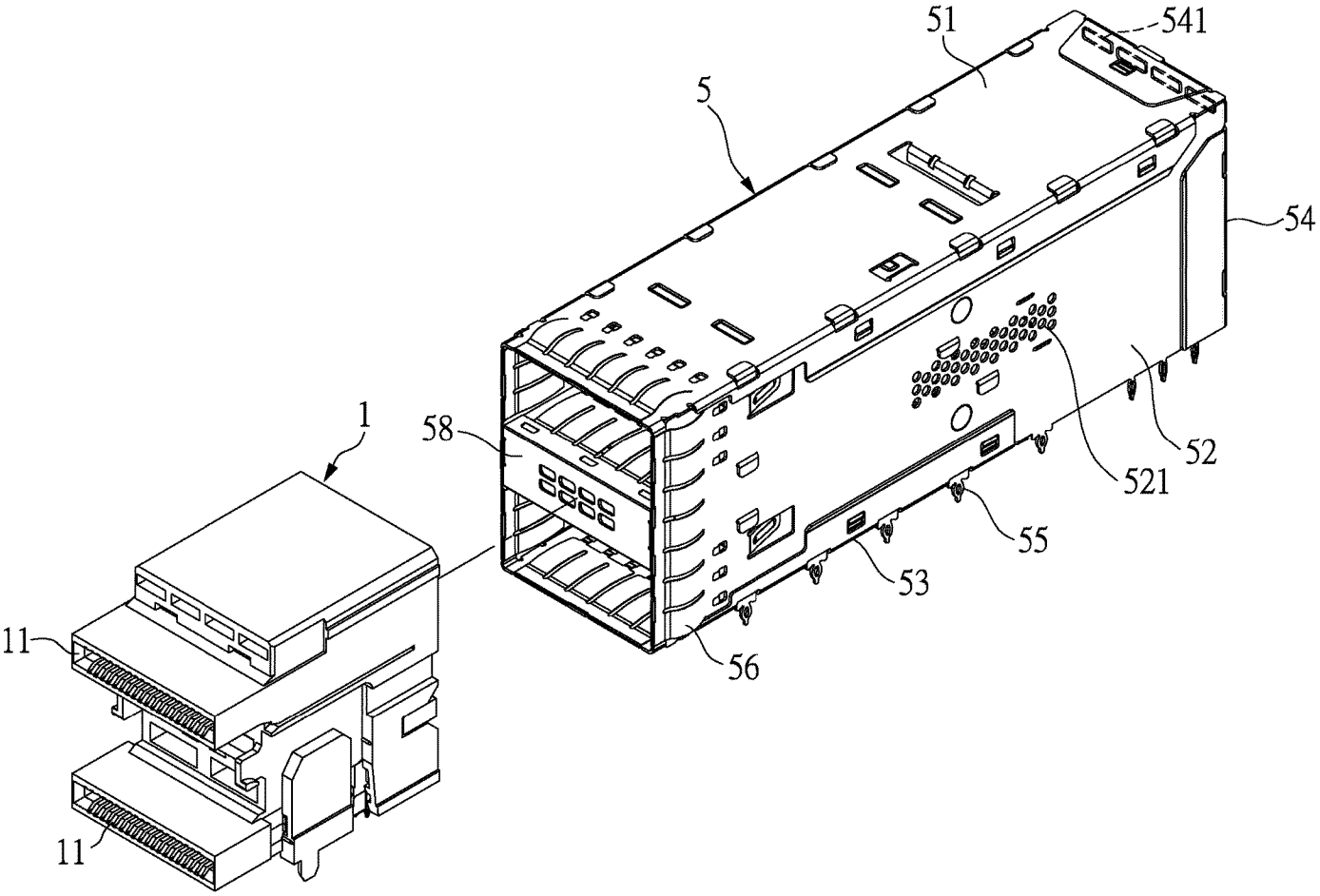
FIG. 1 is a three-dimensional exploded view of the high frequency signal communication connector of the present disclosure.
Figure 2:
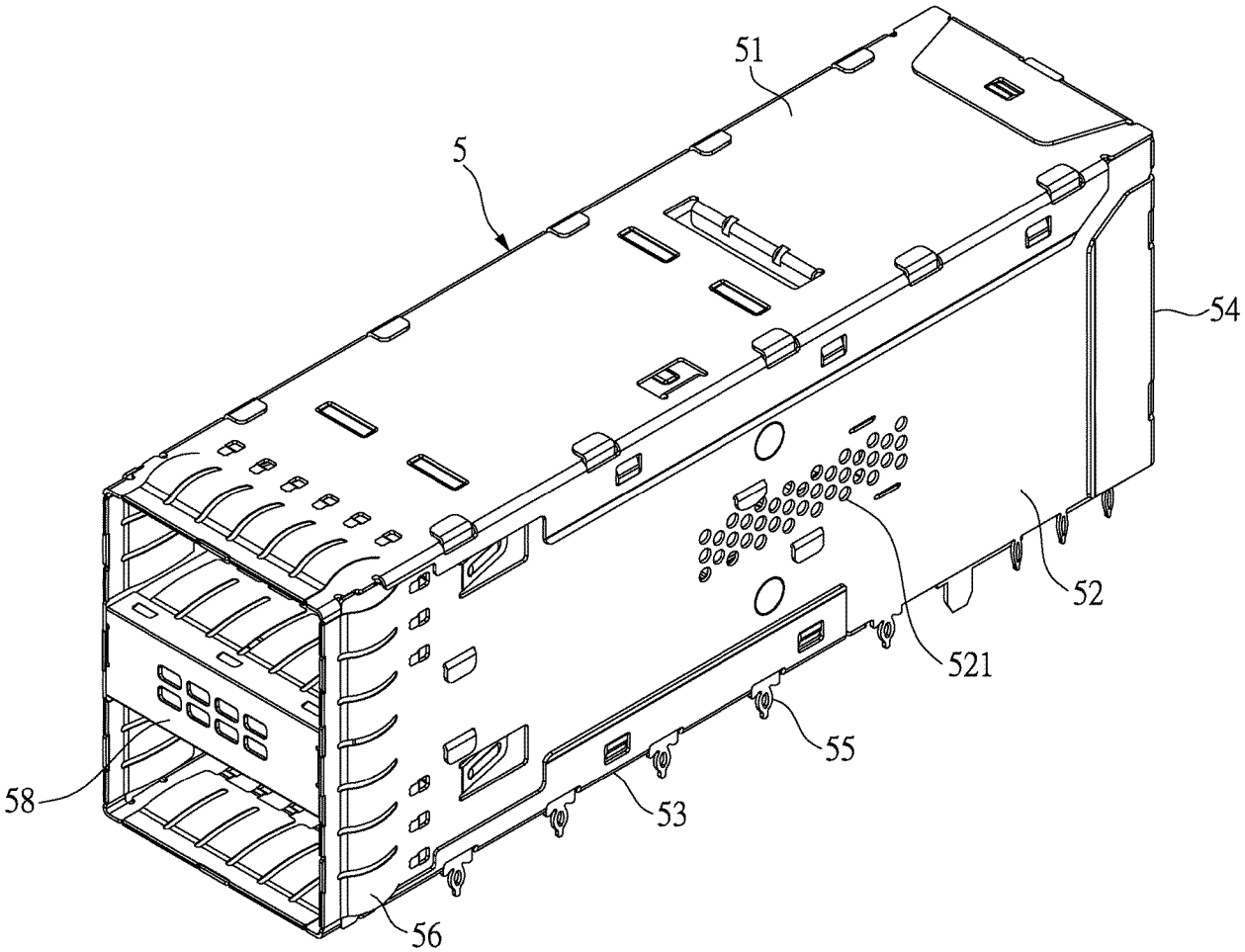
FIG. 2 is a three-dimensional diagram of the high frequency signal communication connector of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

Please refer to FIG. 1 to FIG. 5. The present disclosure provides a high frequency signal communication connector with improved crosstalk performance which meets the specification of the small pluggable connector. The connector is a double-layered structure, and includes an insulated housing 1, a plurality of first terminals 2, a plurality of second terminals 3, a conductive shielding layer 4 and a metal shell 5.

The insulated housing 1 is made of insulating material such as plastic. The insulated housing 1 has two inserting slots 11 respectively disposed at an upper end and a lower end of the insulated housing 1. The plurality of first terminals 2 and the plurality of second terminals 3 are made of conductive metal or alloy material meeting the specification of the terminals of the small pluggable connector. The plurality of first terminals 2 and the plurality of second terminals 3 include signal terminals, power source terminals, grounding terminals, and so on. The plurality of first terminals 2 and the plurality of second terminals 3 are disposed on the insulated housing 1, and a front end (contact part) of each of the plurality of first terminals 2 and a front end (contact part) of each of the plurality of second terminals respectively extend to the two inserting slots 11 to be in contact with the terminals of a connector (optical module) to have an electrical connection therewith. A rear end (pin) of each of the plurality of first terminals 2 and a rear end (pin) of each of the plurality of second terminals 3 extend outside a bottom of the insulated housing 1 for electrically connecting with a circuit board, thereby enabling the present disclosure to electrically connect with the circuit board.

In the present embodiment, the plurality of first terminals 2 are respectively disposed on a first module 12 and a second module 13 by using the insert molding, and the plurality of second terminals 3 are respectively disposed on a third module 14 and a fourth module 15 by using the insert molding. The first module 12, the second module 13, the third module 14 and the fourth module 15 are stacked and assembled in the insulated housing 1. A rear plate 16 is fixed at a rear side of the insulated housing 1 to enable the plurality of first terminals 2 and the plurality of second terminals 3 to be disposed in the insulated housing 1. The stacked structure applied in the present embodiment is beneficial to reduce the number of components.

The conductive shielding layer 4 is made of conductive material, and preferably, conductive plastic having better plasticity, and the present disclosure is not limited thereto. The conductive shielding layer 4 can be disposed on, at the bottom of, and in the insulated housing 1 alternatively. In the present embodiment, the conductive shielding layer 4 is disposed at the bottom of the insulated housing 1 by using a clamp.

The conductive shielding layer 4 is a plate body of which the shape may be a square or another shape which corresponds to the distribution of the rear ends of the plurality of first terminals 2 and the rear ends of the plurality of second terminals 3. A thickness and a height of the conductive shielding layer 4 are not limited. In the present embodiment, the conductive shielding layer 4 is a plate body with an uneven height and a stepped top surface, and the insulated housing 1 has a stepped bottom surface corresponding to the stepped top surface of the conductive shielding layer 4, thereby enabling the conductive shielding layer 4 to connect with the bottom of the insulating housing 1. The conductive shielding layer 4 is disposed with a plurality of through holes 41 which respectively penetrate a top surface and a bottom surface of the conductive shielding layer 4. The plurality of first terminals 2 and the plurality of second terminals 3 respectively penetrate the plurality of through holes 41 and then are positioned by the plurality of through holes 41. The rear ends of the plurality of first terminals 2 and the rear ends of the plurality of second terminals 3 pass through the plurality of through holes 41 to extend outside the bottom surface of the conductive shielding layer 4.

Figure 6:
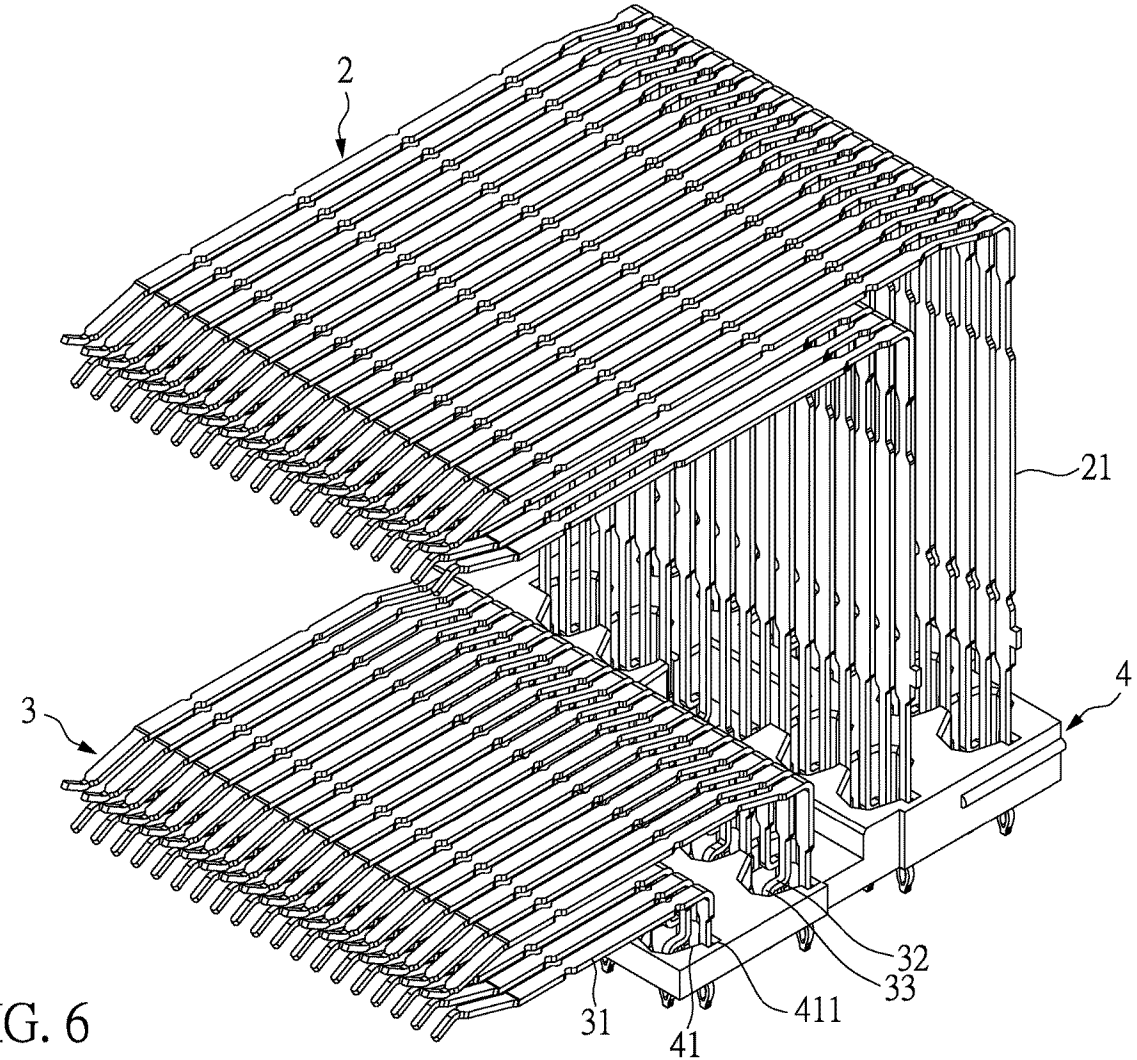
FIG. 6 is a three-dimensional diagram of the first terminals, the second terminals and the conductive shielding layer of the present disclosure.
Figure 7:
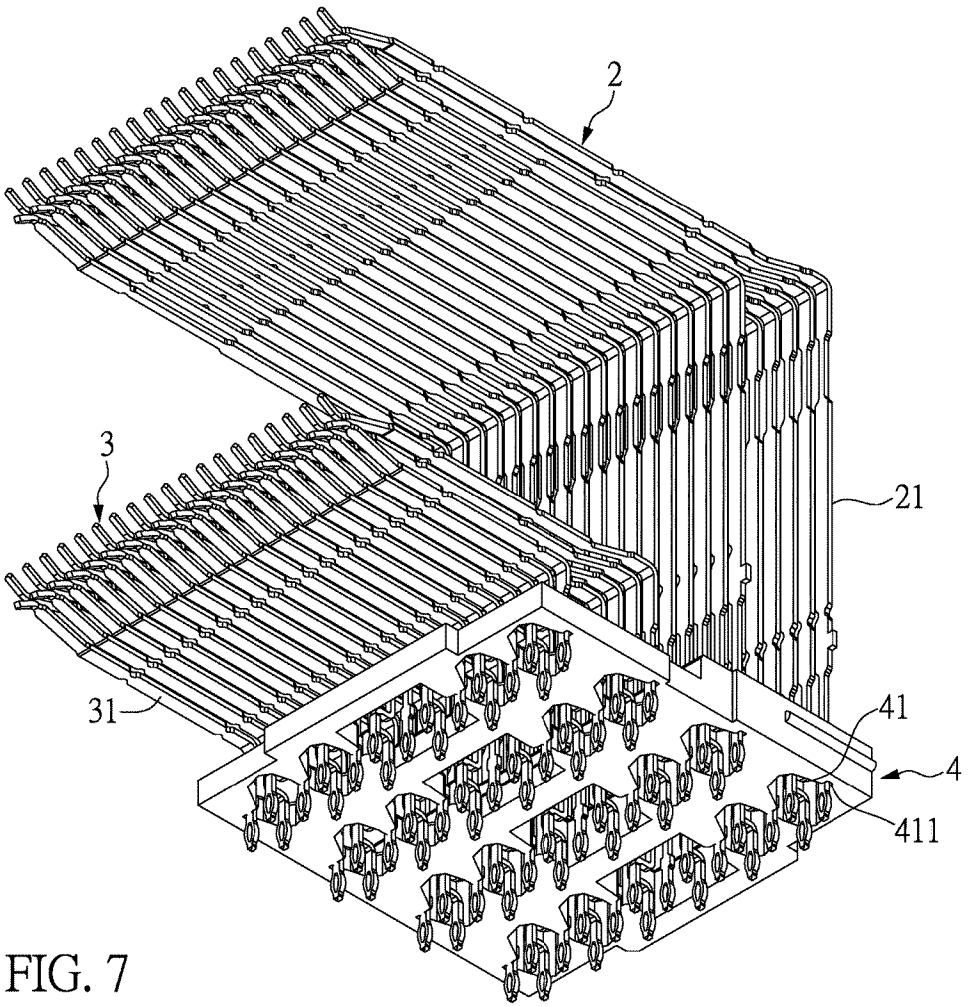
FIG. 7 is a three-dimensional diagram of another angle of the first terminals, the second terminals and the conductive shielding layer of the present disclosure.

A shape and a size of each of the plurality of through holes 41 is not limited, and they can be made according to the distribution of the rear ends of the plurality of first terminals 2 and the rear ends of the plurality of second terminals 3. As shown in FIG. 6 and FIG. 7, the plurality of first terminals 2 have a plurality first grounding terminals 21 and the plurality of second terminals 3 have a plurality of second grounding terminals 31, wherein the plurality of first grounding terminals 21 and the second grounding terminals 31 are in contact with the conductive shielding layer 4.

Figure 12:
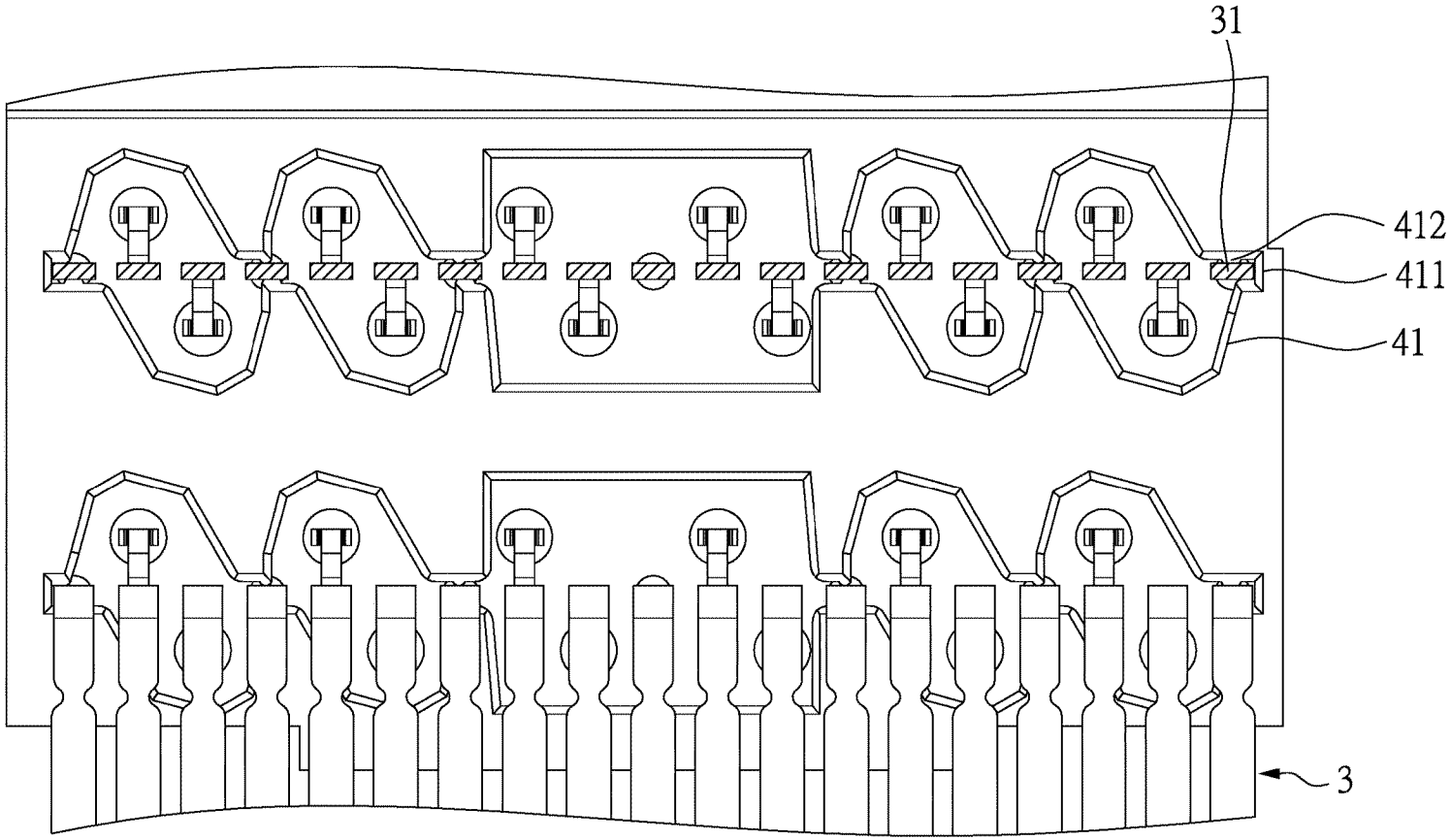
FIG. 12 is a top view of the second terminals and the conductive shielding layer of the present disclosure.

To be precise, an accommodating groove 411 is disposed at an end of each of the plurality of through holes 41 corresponding to each of the plurality of first grounding terminals 21 and each of the plurality of second grounding terminals 31, and an internal side of the accommodating groove 411 is disposed with a convex point 412 (shown in FIG. 12). Each of the plurality of first grounding terminals 21 and each of the plurality of second grounding terminals 31 respectively pass through the accommodating groove 411, and each of the convex points 412 abuts against each of the plurality of first grounding terminals 21 and each of the plurality of second grounding terminals 31 respectively, thereby enabling the plurality of first grounding terminals 21 and the plurality of second grounding terminals 31 to be in contact with the conductive shielding layer 4. As long as the first grounding terminal 21 and the second grounding terminals 31 can be commonly grounded with the conductive shielding layer 4, the present disclosure does not limit the mariner of contacting.

As shown in FIG. 6 and FIG. 7, the conductive shielding layer 4 covers a part of the plurality of first terminals 2 and a part of the plurality of second terminals 3. The plurality of first terminals 2 and the plurality of second terminals 3 respectively pass through the plurality of through holes 41 and are covered by the conductive shielding layer 4. In addition, the plurality of first grounding terminals 21 and the plurality of second grounding terminals 31 are commonly grounded with the conductive shielding layer 4.

In the present disclosure, the conductive shielding layer 4 is disposed at the bottom of the insulated housing 1, and corresponds to a position where the rear ends of the plurality of first terminals 2 and the rear ends of the plurality of second terminals 3 are close to the circuit board, wherein the position has the maximum crosstalk. The conductive shielding layer 4 can be disposed in such a position to effectively avoid the crosstalk interference.

In addition, an insulating sheet 6 can be disposed at the bottom of the conductive shielding layer 4, wherein the insulating sheet 6 can be made of insulating materials such as the Mylar sheet. The insulating sheet 6 is disposed at the bottom of the conductive shielding layer 4 to prevent the conductive shielding layer 4 from contacting with the circuit board. A plurality of pass holes 61 are disposed on the insulating sheet 6, and the rear ends of the plurality of first terminals 2 and that of the plurality of second terminals 3 respectively pass through the plurality of pass holes 61.

The metal shell 5 is used as a shielding member to cover an external portion of the insulated housing 1 to avoid electromagnetic interference. The metal shell 5 includes a top cover 51, a pair of side covers 52, a bottom cover 53, and a rear cover 54, wherein the top cover 51, the pair of side covers 52, the bottom cover 53 and the rear cover 54 are made of a rectangular metal plate. The top cover 51 and the bottom cover 53 are respectively connected to upper ends and lower ends of the pair of side covers 52, the rear cover 54 is connected to a rear end of each of the top cover 51, the pair of side covers 52 and the bottom cover 53. A plurality of pins 55 respectively extend from a lower end of the metal shell 5, that is, the plurality of pins 52 respectively extend from lower ends of the pair of side covers 52 and the rear cover 54, and are connected to the circuit board by using plugging or welding. A front end of the metal shell 5 is disposed with a plurality of grounding elastic pieces 56 which are respectively distributed on the top cover 51, the pair of side covers 52 and the rear cover 53. The plurality of grounding elastic pieces 56 protrude from the metal shell 5 to be in contact with an external ground source (not shown) for avoiding electromagnetic interference. An intermediate partition 57 (shown in FIG. 3) is disposed in the middle of the metal shell 5, wherein the intermediate partition 57 is made of a metal material and partitions the internal part of the metal shell 5 to have an upper space and a lower space for respectively accommodating the two connectors.

In the present embodiment, a plurality of first heat dissipation holes 521 are respectively disposed on the pair of side covers 52 of the metal shell 5, wherein the plurality of first heat dissipation holes 521 are disposed in the middle of the pair of side covers 52 and correspond to the intermediate partition 57. When a connector (optical module) is connected to the two inserting slots 11, the high temperature generated by the connector (optical module) is transmitted to the pair of side covers 52 through the intermediate partition 57 and dissipated by the plurality of first heat dissipation holes 521. Preferably, each of the plurality of first heat dissipation holes 521 is a circular hole, and the present disclosure is not limited thereto. In addition, the plurality of first heat dissipation holes 521 are made of small diameter and distributed with high density. Each of the plurality of first dissipation holes 521 has a diameter ranging from 0.6 mm to 1.4 mm, and preferably, 1 mm. In addition, the plurality of first dissipation holes 521 are disposed at intervals, wherein each of the intervals is between 0.5 mm and 1.5 mm, thereby distributing the plurality of first dissipation heat holes 521 with high density. In addition to dissipating heat, the plurality of first dissipation holes 521 can effectively block a 20 dB interference source.

In the present embodiment, the rear cover 54 of the metal shell 5 is disposed with a plurality of second heat dissipation holes 541, wherein the plurality of second heat dissipation holes 541 are close to the upper end of the rear cover 54. Each of the plurality of second heat dissipation holes 51 is a rectangular hole, and the present disclosure is not limited thereto. The plurality of second heat dissipation holes 541 are arranged in a row and have level height, and are also used to dissipate heat.

Figure 3:
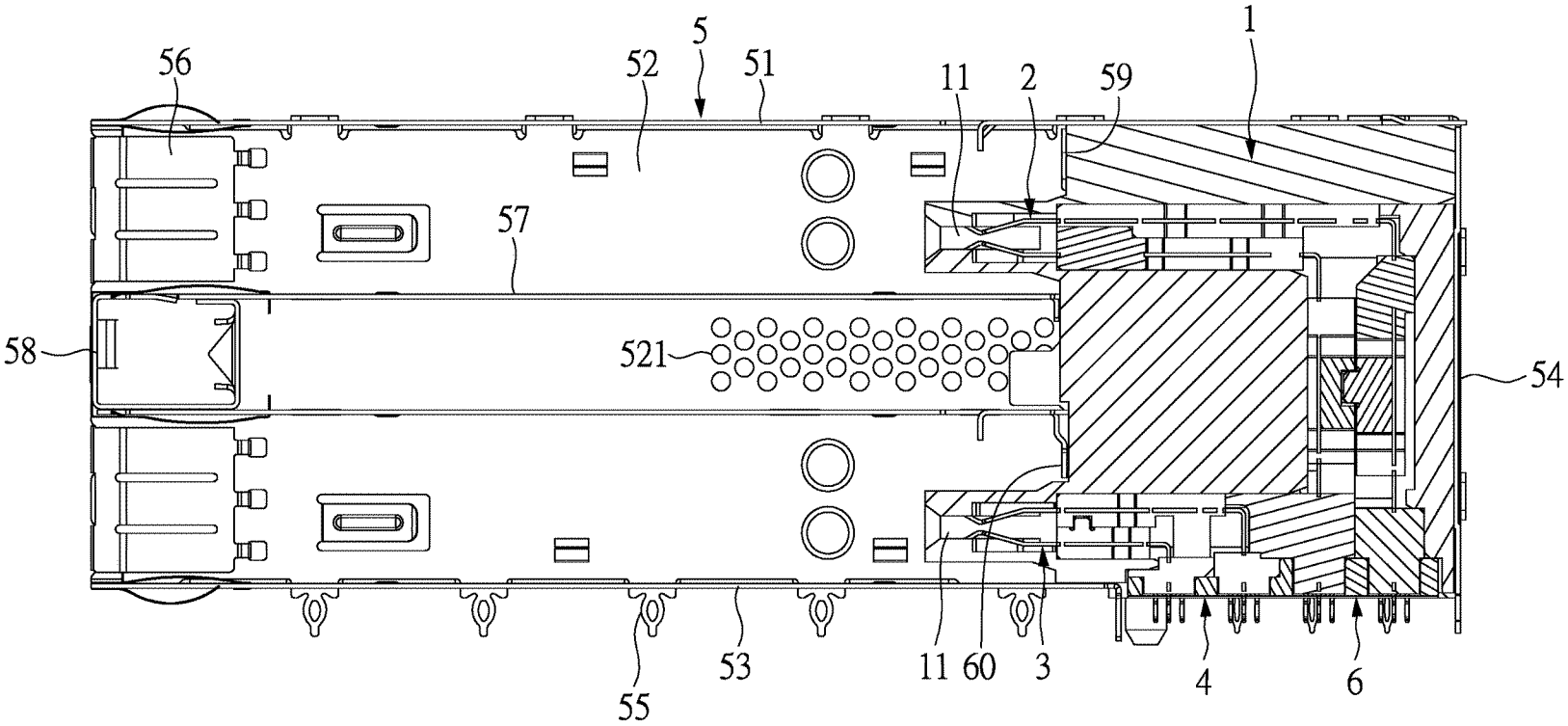
FIG. 3 is a sectional view of the high frequency signal communication connector of the present disclosure.
Figure 4:
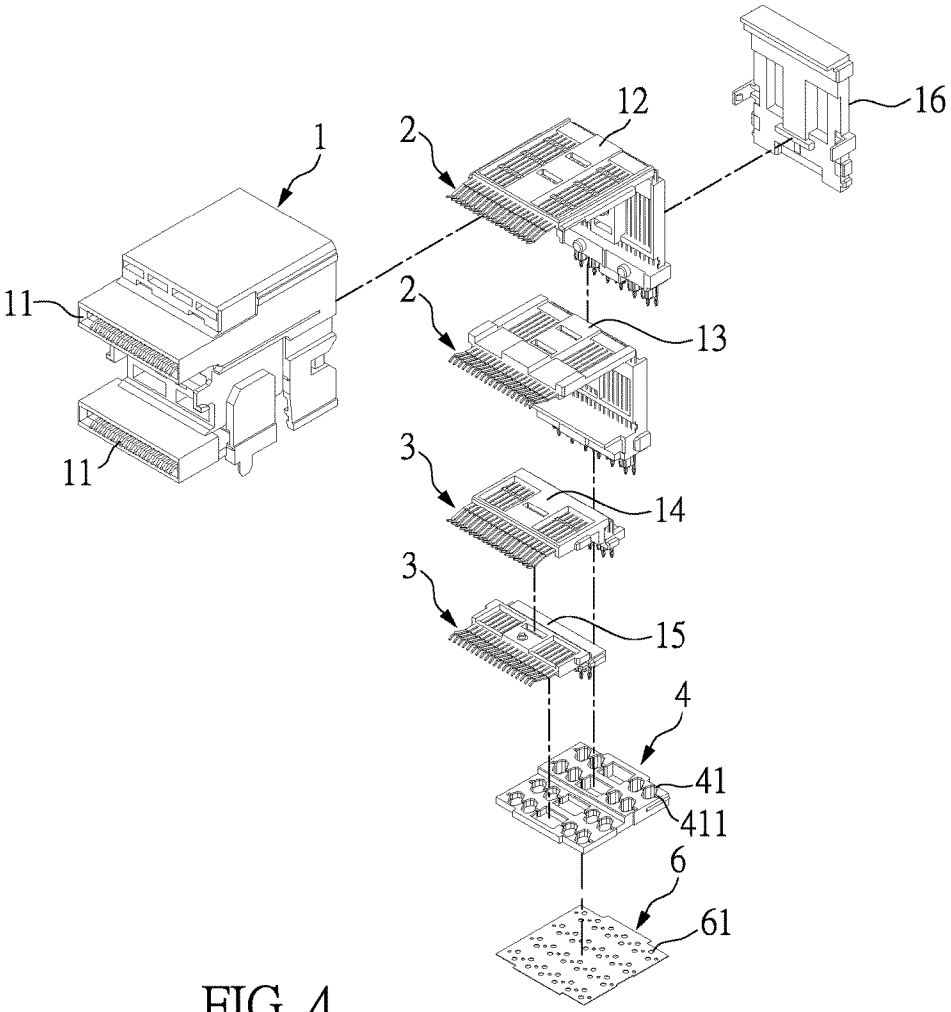
FIG. 4 is a three-dimensional exploded view of the high frequency signal communication connector of the present disclosure without assembling the metal shell.
Figure 5:
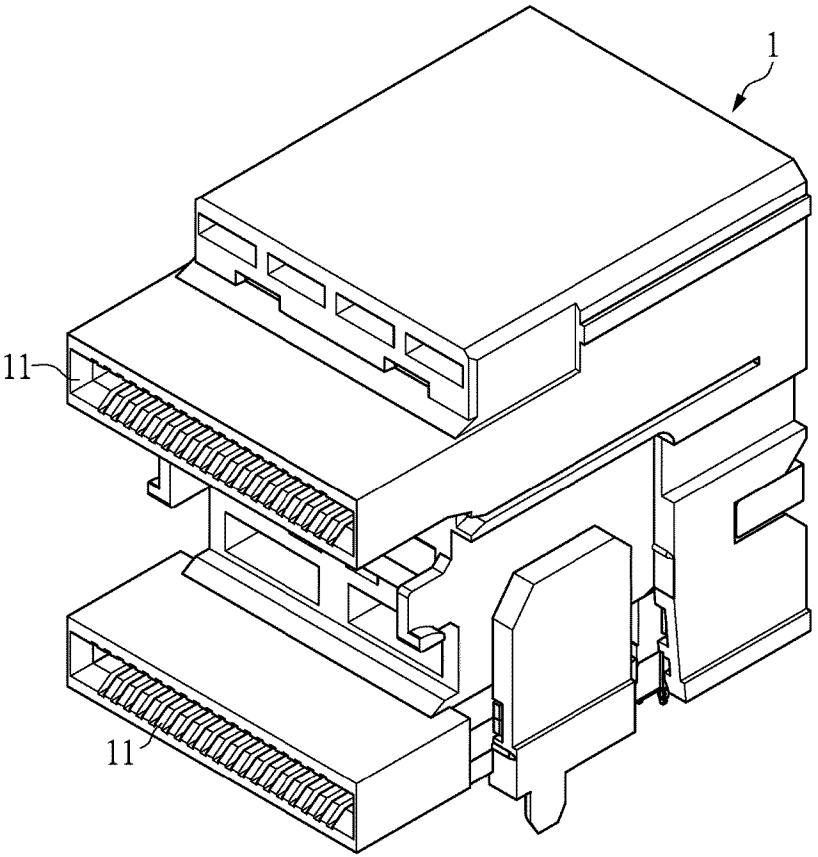
FIG. 5 is a three-dimensional diagram of the high frequency signal communication connector of the present disclosure without assembling the metal shell.
Figure 11:
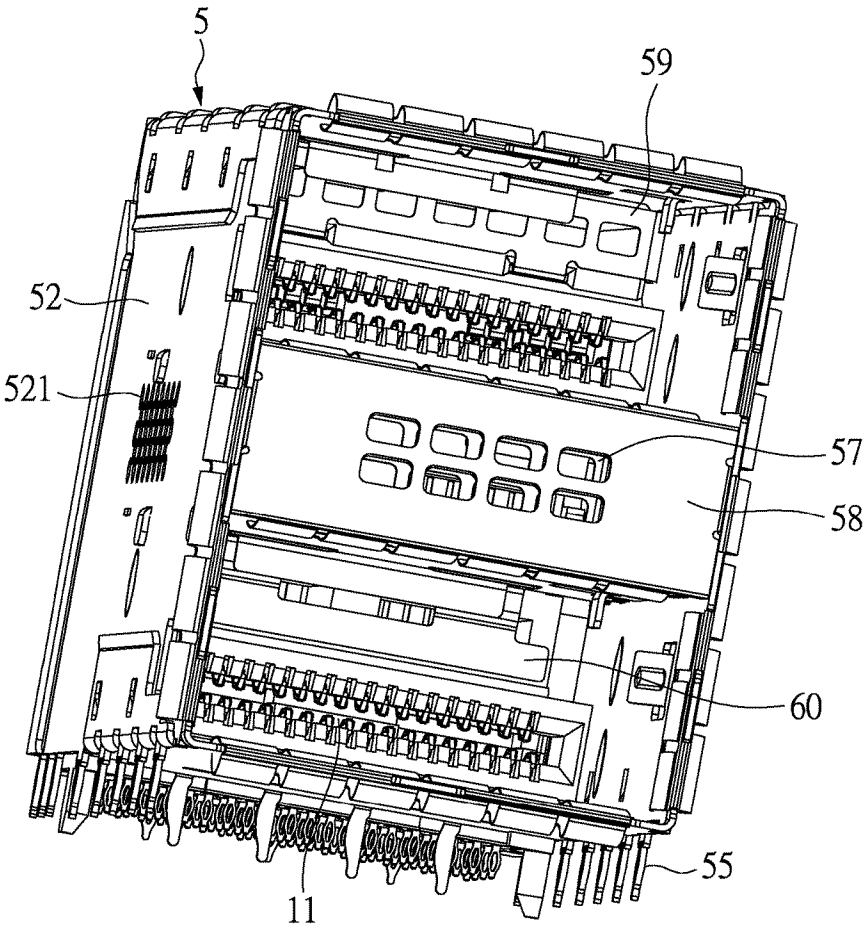
FIG. 11 is a three-dimensional diagram of another angle of the high frequency signal communication connector of the present disclosure.

Please refer to FIG. 3 and FIG. 11. In the embodiments, a first metal partition plate 58, a second metal partition plate 59 and a third metal partition plate 60 are disposed on the metal shell 5, wherein the first metal partition plate 58 is disposed at the front end and in the middle of the metal shell 5, and the second metal partition plate 59 and the third metal partition plate 60 are respectively disposed on the two inserting slots 11 respectively disposed at the upper end and the lower end of the insulated housing 1. The first metal partition plate 58, the second metal partition plate 59 and the third metal partition plate 60 all have shielding effectiveness.

Figure 8:
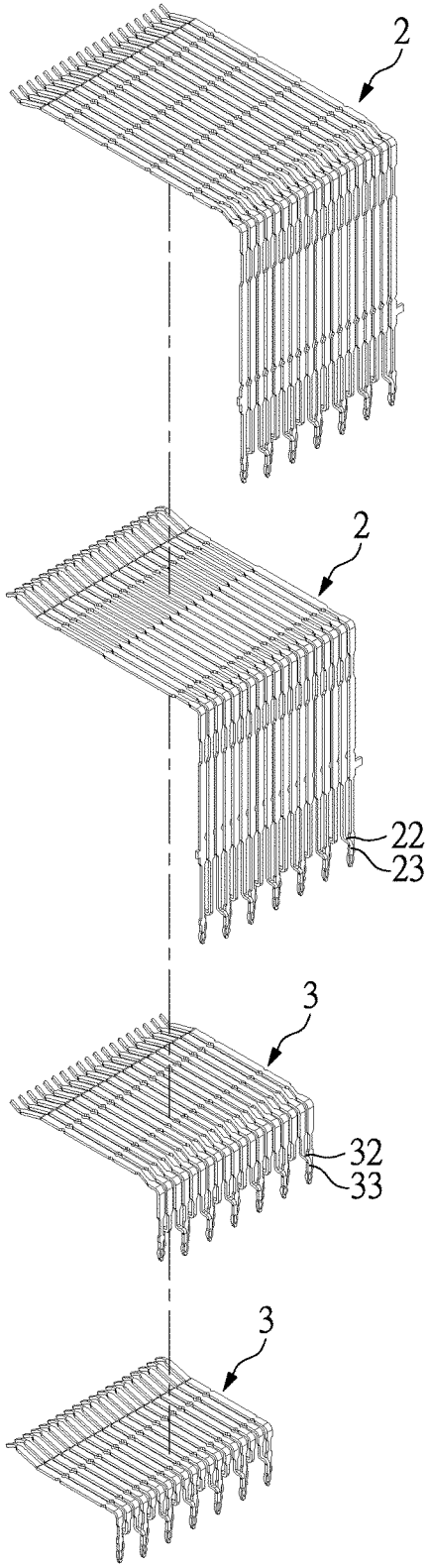
FIG. 8 is a three-dimensional diagram of the first terminals and the second terminals of the present disclosure.

Please refer to FIG. 8. In the present embodiment, one part of the rear ends of the plurality of first terminals 2 is bent relative to the other part of the rear ends of the plurality of first terminals 2 to enable the rear ends of each two adjacent terminals of the plurality of first terminals 2 to be staggered, and one part of the rear ends of the plurality of second terminals 3 is bent relative to the other part of the rear ends of the plurality of second terminals 3 to enable the rear ends of each two adjacent terminals of the plurality of second terminals 3 to be staggered. That is, the pins of the plurality of first terminals 2 and the pins of the plurality of second terminals 3 are staggered respectively to avoid interference generating among the terminals. To be precise, at least one rear end of each pair of terminals of the plurality of first terminals 2 is bent (forward or backward) to form a first horizontal portion 22 and then is bent downward to form a first perpendicular portion 23, and at least one rear end of each pair of terminals of the plurality of second terminals 3 is bent (forward or backward) to form a second horizontal portion 32 and then is bent downward to form a second perpendicular portion 33. The first horizontal portion 22 and the first perpendicular portion 23 are respectively formed on the plurality of first terminals 2 and the second horizontal portion 32 and the second perpendicular portion 33 are respectively formed on the plurality of second terminals 3, so that the pins of the plurality of first terminals 2 and the pins of the plurality of second terminals 3 are staggered.

Figure 9:
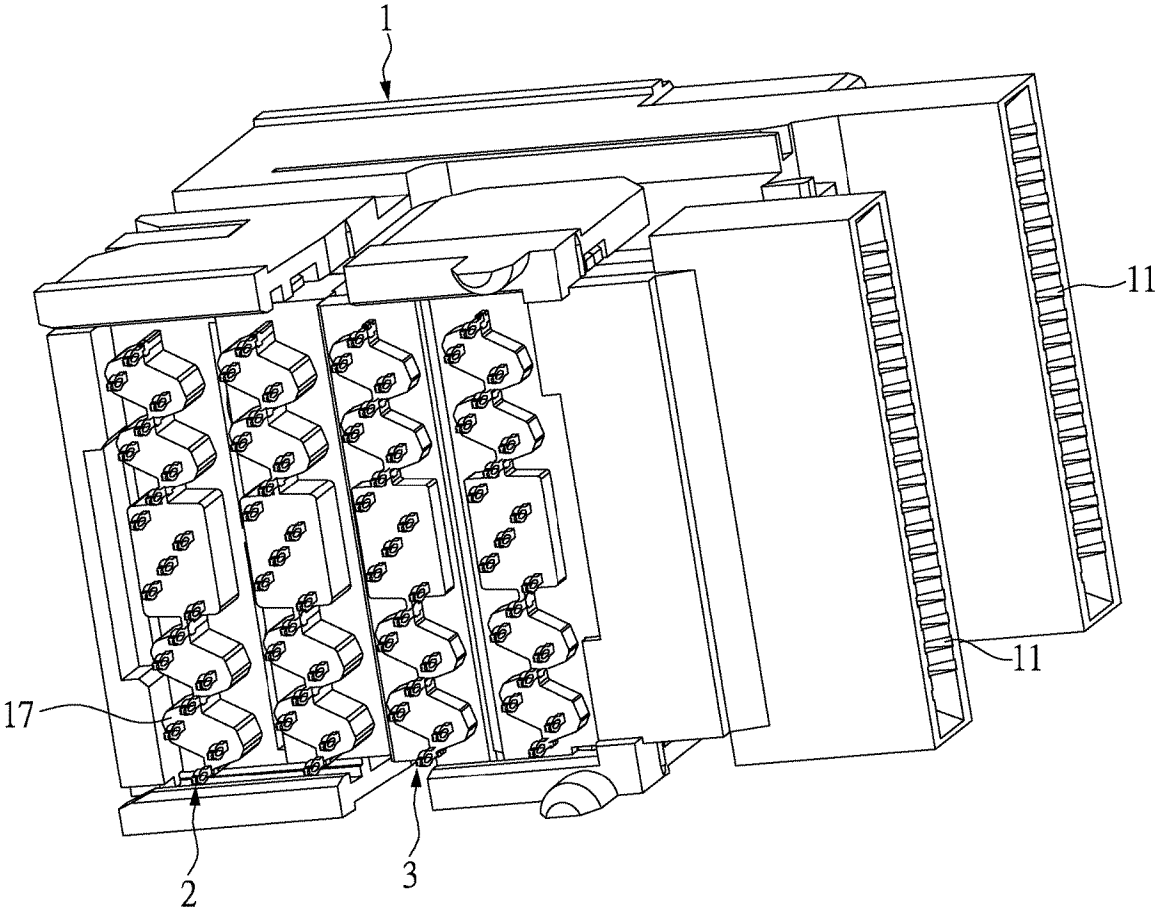
FIG. 9 is the first three-dimensional diagram of a part of the high frequency signal communication connector of the present disclosure.
Figure 10:
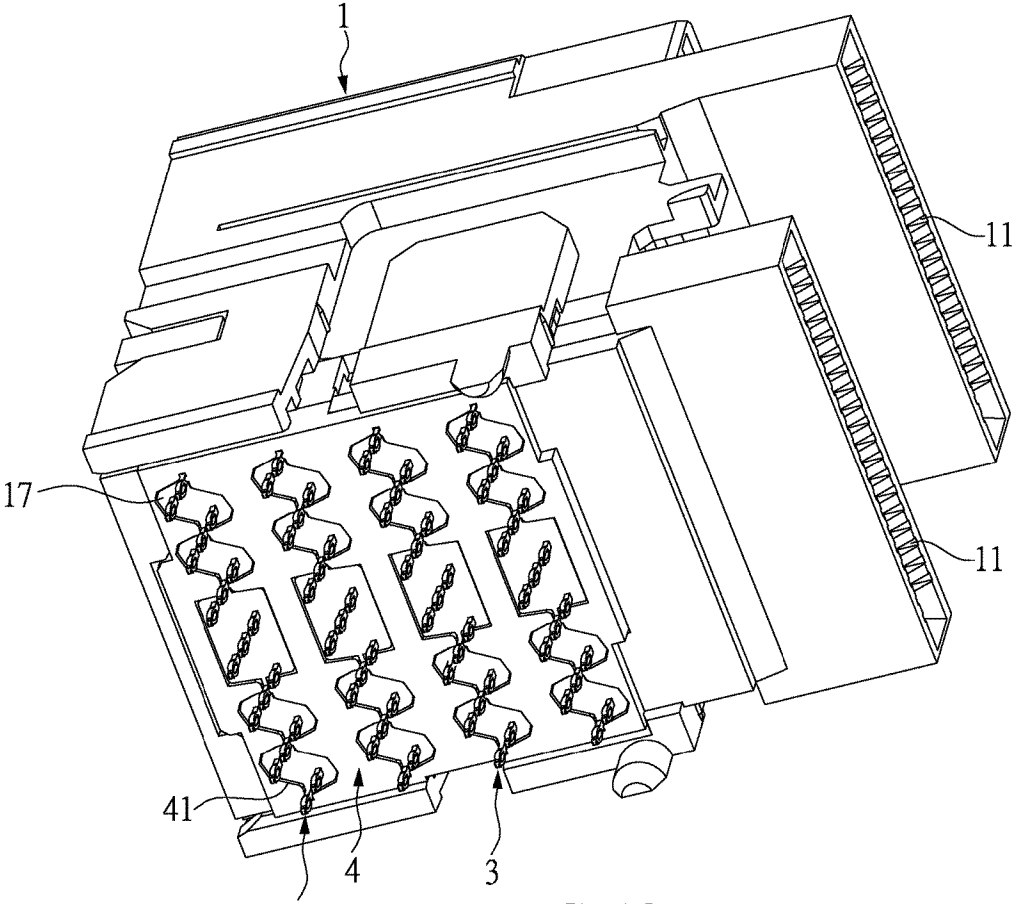
FIG. 10 is the second three-dimensional diagram of a part of the high frequency signal communication connector of the present disclosure.

The bent parts of the plurality of first terminals 2 and that of the plurality of second terminals 3 are in a plurality of convex portions 17 formed at the bottom of the insulated housing 1 (shown in FIG. 9 and FIG. 10). The conductive shielding layer 4 corresponds to the bent parts of the plurality of first terminals 2 and the bent parts of the plurality of second terminals 3 by using the plurality of convex portions 17 and the plurality of through holes 41, thereby avoiding the crosstalk interference.

In summary, the insulated housing of the present disclosure is disposed with a conductive shielding layer thereon, the conductive shielding layer covers a part of the plurality of first terminals and a part of the plurality of second terminals, and is in contact with the plurality of first grounding terminals and the plurality of second grounding terminals to extend the grounding area, thereby providing the terminals with better shielding effectiveness so as to effectively avoid crosstalk interference. Although applying the differential mode to the high frequency signal can have better performance for lowering interference, the anti-interference effect decreases when the high frequency signal is transmitted on one circuit board or the transmission distance changes. The present disclosure provides better effectiveness for lowering inference by using the conductive shielding layer.

In addition, the pair of side covers of the metal shell of the present disclosure are respectively disposed with a plurality of first heat dissipation holes which have small diameter and are arranged with high density. The plurality of first heat dissipation holes not only can dissipate heat, but also effectively block the interference source.

The metal shell of the present disclosure is disposed with the first metal partition plate, the second metal partition plate and the third metal partition plate thereon which have shielding effectiveness. By using the metal shell and the metal partition plates, the electromagnetic interference can be avoided effectively.

One part of the rear ends of the plurality of first terminals is bent relative to the other part of the rear ends of the plurality of first terminals to enable the rear ends of each two adjacent terminals of the plurality of first terminals to be staggered, and one part of the rear ends of the plurality of second terminals is bent relative to the other part of the rear ends of the plurality of second terminals to enable the rear ends of each two adjacent terminals of the plurality of second terminals to be staggered. At least one rear end of each pair of terminals of the plurality of first terminals is bent to form a first horizontal portion and then is bent downward to form a first perpendicular portion, and at least one rear end of each pair of terminals of the plurality of second terminals is bent to form a second horizontal portion and then is bent downward to form a second perpendicular portion to enable the pins of the plurality of first terminals and the pins of the plurality of second terminals to be staggered respectively. The bent parts of the plurality of first terminals are closer to the circuit board than the bent parts of the plurality of second terminals, thereby providing better effectiveness of lowering the crosstalk.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

What is claimed is:

1. A high frequency signal communication connector with improved crosstalk performance, comprising:

an insulated housing having two inserting slots respectively disposed at an upper end and a lower end of the insulated housing, a plurality of first terminals having a plurality of first grounding terminals, a plurality of second terminals having a plurality of second grounding terminals, wherein the plurality of first grounding terminals and the second grounding terminals are disposed on the insulated housing, a front end of each of the plurality of first terminals and a front end of each of the second terminals respectively extend to the two inserting slots of the insulated housing, and a rear end of each of the plurality of first terminals and a rear end of each of the second terminals respectively extend outside a bottom of the insulated housing;

a conductive shielding layer disposed on the insulated housing and having a plurality of through holes, wherein the plurality of through holes penetrate a top surface and a bottom surface of the conductive shielding layer, the plurality of first terminals and the plurality of second terminals respectively pass through the plurality of through holes to make the conductive shielding layer cover a part of the plurality of first terminals and a part of the plurality of second terminals, and the plurality of first grounding terminals and the plurality of second grounding terminals are in contact with the conductive shielding layer to extend a grounding area, and a metal shell covering an external portion of the insulated housing;

wherein one part of the rear ends of the plurality of first terminals is bent relative to the other part of the rear ends of the plurality of first terminals to enable the rear ends of each two adjacent terminals of the plurality of first terminals to be staggered, and one part of the rear ends of the plurality of second terminals is bent relative to the other part of the rear ends of the plurality of second terminals to enable the rear ends of each two adjacent terminals of the plurality of second terminals to be staggered;

wherein bent parts of the plurality of first terminals and bent parts of the plurality of second terminals are in a plurality of convex portions formed at the bottom of the insulated housing, and the conductive shielding layer corresponds to the bent parts of the plurality of first terminals and the bent parts of the plurality of second terminals by using the plurality of convex portions and the plurality of through holes, such that the bent parts of the plurality of first terminals and the bent parts of the plurality of second terminals are in contact with the plurality of convex portions made of insulating material, and are completely enclosed by the plurality of through holes of the conductive shielding layer made of conductive material.

2. The high frequency signal communication connector with improved crosstalk performance according to claim 1, wherein an accommodating groove is disposed at an end of each of the plurality of through holes corresponding to each of the plurality of first grounding terminals and each of the plurality of second grounding terminals, and an internal side of the accommodating groove is disposed with a convex point, each of the plurality of first grounding terminals and each of the plurality of second grounding terminals respectively pass through the accommodating groove, and each of the convex points abuts against each of the plurality of first grounding terminals and each of the plurality of second grounding terminals respectively.

3. The high frequency signal communication connector with improved crosstalk performance according to claim 1, wherein a first metal partition plate, a second metal partition plate and a third metal partition plate are disposed on the metal shell, the first metal partition plate is disposed at a front end and in the middle of the metal shell, and the second metal partition plate and the third metal partition plate are respectively disposed on the two inserting slots respectively disposed at the upper end and the lower end of the insulated housing.

4. The high frequency signal communication connector with improved crosstalk performance according to claim 1, wherein at least one rear end of each pair of terminals of the plurality of first terminals is bent to form a first horizontal portion and then is bent downward to form a first perpendicular portion, and at least one rear end of each pair of terminals of the plurality of second terminals is bent to form a second horizontal portion and then is bent downward to form a second perpendicular portion.

5. The high frequency signal communication connector with improved crosstalk performance according to claim 1, wherein the metal shell has a top cover, a pair of side covers, a bottom cover and a rear cover; the top cover and the bottom cover are respectively connected to upper ends and lower ends of the pair of side covers, the rear cover connects to a rear end of each of the top cover, the pair of side covers and the bottom cover; an intermediate partition is disposed in the middle of the metal shell; the pair of side covers are respectively disposed with a plurality of first heat dissipation holes which correspond to the intermediate partition, each of the plurality of first dissipation holes is a circular hole and has a diameter ranging from 0.6 mm to 1.4 mm, and the plurality of first dissipation holes are disposed at intervals, wherein each of the intervals is between 0.5 mm and 1.5 mm.

6. The high frequency signal communication connector with improved crosstalk performance according to claim 5, wherein a plurality of second heat dissipation holes are disposed on the rear cover of the metal shell, the plurality of second heat dissipation holes are close to an upper end of the rear cover and each of the plurality of second heat dissipation holes is a rectangular hole, and the plurality of second heat dissipation holes are arranged in a row and have level height.

7. A high frequency signal communication connector with improved crosstalk performance, comprising:

an insulated housing having two inserting slots respectively disposed at an upper end and a lower end of the insulated housing, a plurality of first terminals having a plurality of first grounding terminals, a plurality of second terminals having a plurality of second grounding terminals, wherein the plurality of first grounding terminals and the second grounding terminals are disposed on the insulated housing, a front end of each of the plurality of first terminals and a front end of each of the second terminals respectively extend to the two inserting slots of the insulated housing, and a rear end of each of the plurality of first terminals and a rear end of each of the second terminals respectively extend outside a bottom of the insulated housing;

a conductive shielding layer disposed on the insulated housing and having a plurality of through holes, wherein the plurality of through holes penetrate a top surface and a bottom surface of the conductive shielding layer, the plurality of first terminals and the plurality of second terminals respectively pass through the plurality of through holes to make the conductive shielding layer cover a part of the plurality of first terminals and a part of the plurality of second terminals, and the plurality of first grounding terminals and the plurality of second grounding terminals are in contact with the conductive shielding layer to extend a grounding area, and a metal shell covering an external portion of the insulated housing;

wherein the conductive shielding layer is a plate body with an uneven height and a stepped top surface, and the insulated housing has a stepped bottom surface corresponding to the stepped top surface of the conductive shielding layer;

wherein an insulating sheet is disposed at the bottom of the conductive shielding layer, a plurality of pass holes are disposed on the insulating sheet, and the rear end of each of the plurality of first terminals and the rear end of each of the plurality of second terminals pass through the plurality of pass holes;

wherein one part of the rear ends of the plurality of first terminals is bent relative to the other part of the rear ends of the plurality of first terminals to enable the rear ends of each two adjacent terminals of the plurality of first terminals to be staggered, and one part of the rear ends of the plurality of second terminals is bent relative to the other part of the rear ends of the plurality of second terminals to enable the rear ends of each two adjacent terminals of the plurality of second terminals to be staggered;

wherein bent parts of the plurality of first terminals and bent parts of the plurality of second terminals are in a plurality of convex portions formed at the bottom of the insulated housing, and the conductive shielding layer corresponds to the bent parts of the plurality of first terminals and the bent parts of the plurality of second terminals by using the plurality of convex portions and the plurality of through holes, such that the bent parts of the plurality of first terminals and the bent parts of the plurality of second terminals are in contact with the plurality of convex portions made of insulating material, and are completely enclosed by the plurality of through holes of the conductive shielding layer made of conductive material;

wherein an accommodating groove is disposed at an end of each of the plurality of through holes corresponding to each of the plurality of first grounding terminals and each of the plurality of second grounding terminals, and an internal side of the accommodating groove is disposed with a convex point, each of the plurality of first grounding terminals and each of the plurality of second grounding terminals respectively pass through the accommodating groove, and each of the convex points abuts against each of the plurality of first grounding terminals and each of the plurality of second grounding terminals respectively.

8. The high frequency signal communication connector with improved crosstalk performance according to claim 7, wherein the metal shell has a top cover, a pair of side covers, a bottom cover and a rear cover; the top cover and the bottom cover are respectively connected to upper ends and lower ends of the pair of side covers, the rear cover connects to a rear end of each of the top cover, the pair of side covers and the bottom cover; an intermediate partition is disposed in the middle of the metal shell; the pair of side covers are respectively disposed with a plurality of first heat dissipation holes which correspond to the intermediate partition, each of the plurality of first dissipation holes is a circular hole and has a diameter ranging from 0.6 mm to 1.4 mm, and the plurality of first dissipation holes are disposed at intervals, wherein each of the intervals is between 0.5 mm and 1.5 mm.

9. The high frequency signal communication connector with improved crosstalk performance according to claim 7, wherein a plurality of second heat dissipation holes are disposed on the rear cover of the metal shell, the plurality of second heat dissipation holes are close to an upper end of the rear cover and each of the plurality of second heat dissipation holes is a rectangular hole, and the plurality of second heat dissipation holes are arranged in a row and have level height.

10. The high frequency signal communication connector with improved crosstalk performance according to claim 7, wherein a first metal partition plate, a second metal partition plate and a third metal partition plate are disposed on the metal shell, the first metal partition plate is disposed at a front end and in the middle of the metal shell, and the second metal partition plate and the third metal partition plate are respectively disposed on the two inserting slots respectively disposed at the upper end and the lower end of the insulated housing.

* * * * *